US005255885A

United States Patent [19]

Iversen

[11] Patent Number: 5,255,885

[45] Date of Patent: Oct. 26, 1993

[54] MOUNTING DEVICE FOR AN ITEM ON A WALL

[76] Inventor: Edward P. Iversen, 14 Woodview La., Algonquin, Ill. 60102

[21] Appl. No.: 886,236

[22] Filed: May 21, 1992

[51] Int. Cl.[5] ..... A47G 1/16

[52] U.S. Cl. ..... 248/489; 248/220.2; 248/291; 248/498

[58] Field of Search ..... 248/467, 498, 489, 291, 248/220.2, 224.4

[56] References Cited

U.S. PATENT DOCUMENTS 4,040,593 8/1977 Wiley ..... 248/291 X 4,524,539 11/1986 King et al. ..... 248/467 X

*Primary Examiner*—Douglas D. Watts

*Attorney, Agent, or Firm*—Mathew R. P. Perrone, Jr.

[57] ABSTRACT

A device can be secured to wall and have at least one mounting for hanging an item on a wall. The device can include three mounting points for a heavy item. The device can also include two linear mounting points, which may be extended or capped, conform to a room deviation. The device to receive the item to be hung or mounted can further have one mounting point.

17 Claims, 12 Drawing Sheets

FIGURE 3
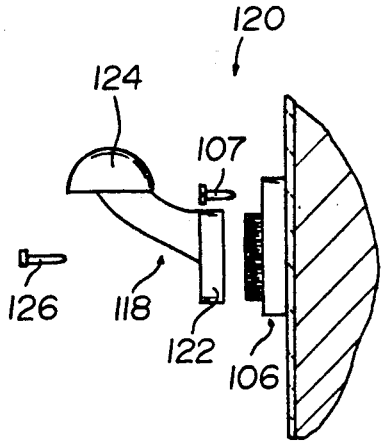
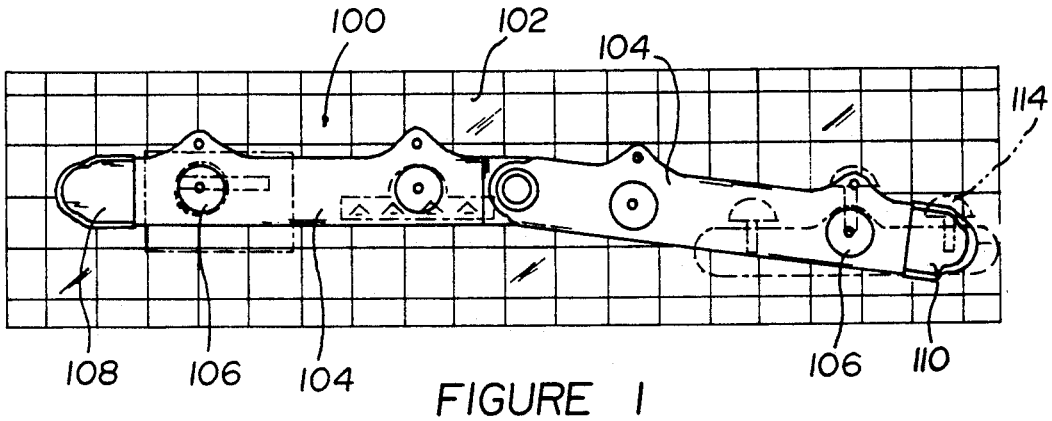
FIGURE 1
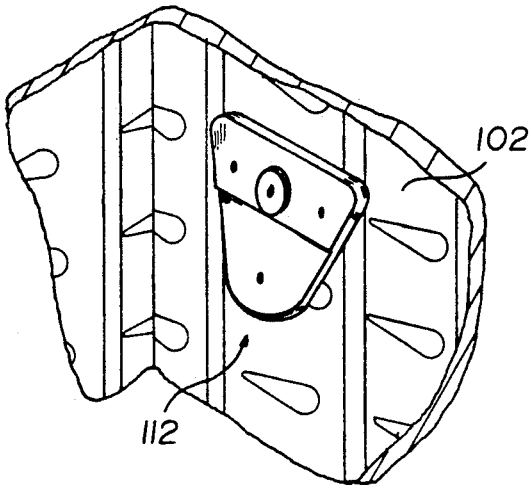
FIGURE 2

MOUNTING DEVICE FOR AN ITEM ON A WALL

This invention relates to a mounting device, and more particularly to a mounting device which permits an item to be easily removed from a wall, yet strongly secured while the item is hung or mounted on a wall.

BACKGROUND OF THE INVENTION

A great difficulty in many cases is to provide a suitable apparatus for hanging items on a wall. Sometimes the device for hanging items on the wall is attached so permanently that the item hung or mounted on the wall cannot be removed without destruction of or severe damage to the wall . Yet, it is highly desirable to sometimes clean, paint or otherwise take action behind an item mounted on the wall. If this can be done, substantial improvements in cleanup factors can be obtained.

It is also desired to simply hang items on the wall firmly, yet without achieving a degree of permanence. if an item can be securely hung or mounted on a wall, without damaging the wall upon removal thereof, simplified decoration and redecoration of the wall or other area can be achieved. With such a simplified decoration or redecoration, great advantages can be obtained.

However, removal of something strongly secured to the wall has a tendency to leave damage on the wall. With the damage on the wall, it becomes difficult to change a position of items hung or mounted on the wall. In order to avoid this hanging problem, a person might leave something hanging on the wall in the undesired position long after the positioning has become undesirable.

This undesirable factor is many times overwhelmed by the fact that sometimes an item is left hanging on the wall for a long period of time due to problems with a position change. Such a position change can require major remodeling to achieve the decoration changes. It is highly desirable to achieve moving of items on the wall, without requiring a major remodeling project for the wall.

It is also very difficult to hang any item on a wall in an apartment or other rented living space. Rarely does a property owner permit a tenant to to hang a picture, a plaque or a similar item on the wall. This, of course, is attributable to the resulting damage, almost inherently caused by mounting items on a wall.

The possibility of wall damage also renders it difficult to make efficient use of wall space. If an efficient way of mounting items on a wall can be combined with an efficient way of moving those items as desired, the advantages thereof become clear. It is very desirable if these advantages can be obtained without damaging the wall and with greatly facilitating the moving of the items.

SUMMARY OF THE INVENTION

Among the many objectives of this invention is the provision of a device for hanging an item on a wall, which minimizes damage to a wall, while permitting the item to be easily removed or repositioned on a wall.

A further objective of this invention is to provide a device for hanging an item on a wall, which item may be easily removed from the wall.

A still further objective of this invention is to provide a device for hanging an item on a wall, which item may be easily moved to another position on the wall.

Yet a further objective of this invention is to provide a device for hanging an item on a wall to minimize a cleaning problem of the wall.

Also an objective of this invention is to provide a device for hanging an item on a wall temporarily.

Another objective of this invention is to provide a device for hanging an item on a wall securely.

Yet another objective of this invention is to provide a simplified, device for hanging an item on a wall, which is easily installed.

Still another objective of this invention is to provide a device for hanging an item on a wall, which device is strongly secured to the wall.

A further objective of this invention is to provide a device for hanging an item on a wall, which permits simplified decoration.

A still further objective of this invention is to provide a device for hanging an item on a wall, which item may be easily moved to another position on the wall, which permits simplified redecoration.

Yet a further objective of this invention is to provide a device for hanging an item on a wall to minimize damage to the wall.

Also an objective of this invention is to provide a device for hanging an item on a wall which minimizes redecoration requirements.

Another objective of this invention is to provide a device for hanging an item on a wall while providing for ease of moving the item from one position to another.

These and other objectives of the invention (which other objectives become clear by consideration of the specification, claims and drawings as a whole) are met by providing a device for hanging an item on a wall. The device can include three mounting points for a heavy item. The device can also include two linear mounting points, which may be extended or capped, conform to a room deviation. The device to receive the item to be hung or mounted can further have one mounting point.

BRIEF DESCRIPTION OF THE DRAWINGS

FIG. 1 depicts the extendable wall mounting device 100 on wall 102.

FIG. 2 depicts the angled bracket 112 of the extendable wall mounting device 100.

FIG. 3 depicts sweater hanger 120.

Throughout the figures of the drawings, where the same part appears in more than one figure of the drawings, the same number is applied thereto.

DESCRIPTION OF THE PREFERRED EMBODIMENTS

Figure 4:
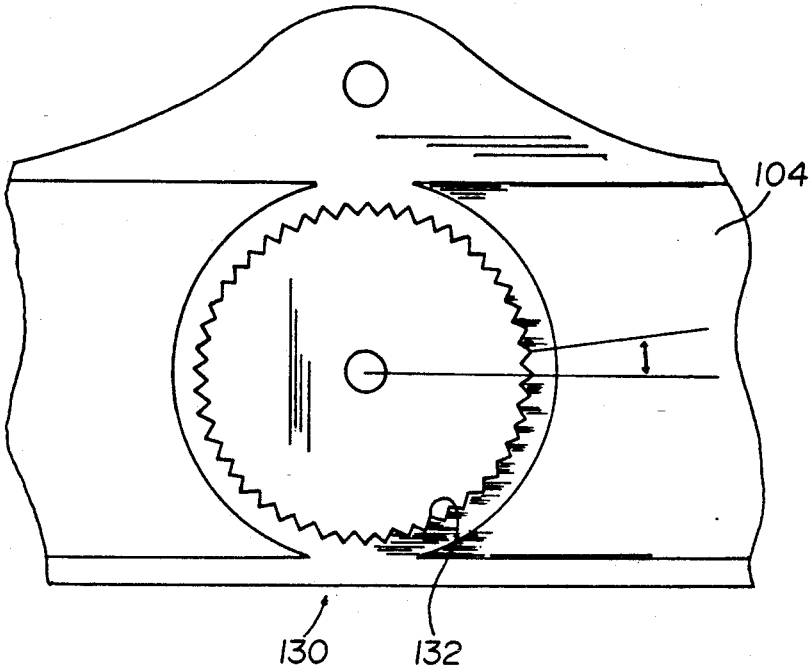
FIG. 4 depicts a close-up of mounting wheel 130.

The device of this invention readily supports many different types of items to be hung on a wall. The device can include three mounting points for strongly supporting a heavy item. The device can include two linear mounting points. With two linear mounting points, the device is extended or capped, to conform to a room deviation. The device can also have one mounting point.

The flat back version is cored out in front. The coring provides for less use of material and stronger parts. The flat back version permits double sided tape to be used for mounting. This tape mounting can also be used either alone or in conjunction with screw mounting.

Where the screw mounting is used alone, the front surface is flat and the rear surface is cored out to provide for the strength and reduction in the use of the material. The mounting brackets can be either three stage, expandable or single stage. An adapter can fit onto the mounting brackets and achieve variations in the devices that can be mounted thereon. This screw mounting can also be used either alone or in conjunction with the tape mounting.

The forty eight points for the mounting device are preferred because the mounting bracket on the item to be mounted can be rotated thereon to achieve a desired position, such as being mounted horizontally, in spite of other difficulties. This feature compensates for a wall deviation or other problem. The other bracket capable of fitting thereon to hold the plate therein is sufficient can be adjusted so that device might be level. This device thus becomes especially useful in commercial installations.

The mounting device may be used in conjunction with a second mounting device or even a third mounting device. It is customary, when utilizing this invention to eliminate the forty eight points when a plurality of the mounting device is supporting an especially heavy item. The number of points may even be changed. However, the forty eight points provide for ease of molding and adjustability.

Sometimes it is desired in a commercial installation to remove an item, such as a paper towel dispenser, without doing severe damage to the wall. If the towel rack or other container can be removed from the wall, the wall can be cleaned or painted therebehind and the towel rack easily reinstalled on the brackets. The towel rack or other item conceals the bracket, so the painting or coloring of the bracket while the wall is being painted, is unimportant. This greatly simplifies the repairs. The double back tape surface permits mounting on flat surfaces and other advantages.

With the bracket mounted on the wall, it is unnecessary to tear the wall apart to remove the bracket therefrom. By the same token then, the towel holder or similar device can be removed therefrom, repaired or replaced without damaging the wall. This simplifies the repair of a commercial area such as a restroom and the inherent damage done thereto by the normal wear and tear due to the heavy use thereof, or intentional vandalism.

Referring now to FIG. 1, the extendable wall mounting device 100 is depicted on wall 102. The wall mounting device 100 is depicted as having two elongated units thereof. Each elongated unit is generally an extendable mounting piece 104 having a generally elongated, modified, rectangular shape.

Each extendable mounting piece 104 has a device mounting wheel 106 secured thereon or molded as a part thereof. Onto the device mounting wheel 106 can be attached any suitable item. Whatever the item is, it includes a portion capable of joining with device mounting wheel 106.

The ends of each extendable mounting piece 104 are oppositely disposed to provide for such extension. A first lower end 108 is situated at one end thereof. As the extendable mounting piece 104 is placed on wall 102, first lower end 108 abuts the wall 102.

Oppositely disposed from first lower end 108 on extendable mounting piece 104 is second raised end 110. A first lower end 108 on a first extendable mounting piece 104 can slide under a second raised end 110 of a second extendable mounting piece 104. In this manner a first extendable mounting piece 104 is joined to a second extendable mounting piece 104. This procedure is repeated as desired to have extendable wall mounting device 100 contain as many of extendable mounting piece 104 and be as long as desired. In this fashion, as many of these units as desired may be joined and extend along the wall as far as desired.

In FIG. 2, an angled bracket 112 is shown as permitting extendable mounting piece 104 to continue extendable wall mounting device 100 on around the wall 102. Thus extendable wall mounting device 100 can completely encircle a room (not shown) . Device mounting wheel 106 (shown in FIG. 3) has secured thereto a jewelry hanger 114 capable of receiving necklaces or similar items in the v-slot 116 protruding from the jewelry hanger 116.

Shown in FIG. 3, is a sweater hanger 118. Sweater hanger 118 cooperates with extendable wall mounting device 100 by having a sweater base 122 (preferably three of sweater base 122 thereon) and a sweater receiver 124 for each sweater base 122. The sweater receiver 124 is an enlarged knob extending from the sweater base 122. The sweater hanger 118 is bolted or otherwise secured to device mounting wheel 106 by a mounting bolt 126 passing therethrough and into device mounting wheel 106.

In FIG. 4, the extendable mounting piece 104 is shown as a close-up of mounting wheel 130. Mounting wheel 130 is a raised, cylindrically-shaped portion of the extendable mounting piece 104. On mounting wheel 130 is at least one one point or raised ridge 132. The raised ridges 132 are preferably forty eight in number and are on the outside cylinder wall running parallel to the cylindrical axis. The forty eight raised ridges 132 provide for ease of molding and positioning of a device mounted thereon.

For example, sweater hanger 118 is shaped to be a female receiver for mounting wheel 130 and the forty eight of raised ridge 132. With the forty eight points of raised ridge 132, a device mounted thereon can be positioned in any suitable fashion thereon no matter how the base plate is positioned. In this fashion, the sweater hanger 118 can be positioned properly due to sweater base 122 having a variety of positions on mounting wheel 130, no matter how extendable mounting piece 104 is positioned.

Figure 5:
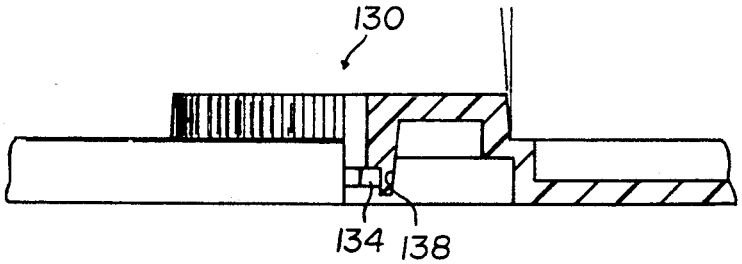
FIG. 5 depicts a partial cross sectional side view of FIG. 4.
Figure 6:
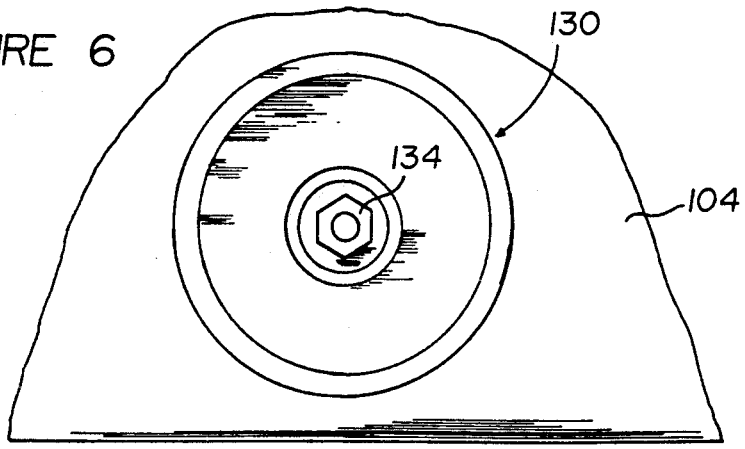
FIG. 6 depicts a partial rear view of FIG. 4.

In FIG. 5, which is a partial cross-section of the FIG. 4, and FIG. 6, which is a rear partial view of FIG. 4, mounting nut 134 is shown as mounted coaxially within mounting wheel 130. Mounting nut 134 is capable of receiving a mounting bolt 126 for mounting any device on mounting wheel 130 such as sweater hanger 120. The mounting bolt 126 passes through an aperture in sweater base 122 into mounting nut 134 to hold sweater hanger 120 on mounting wheel 130. The mounting nut 134 is machined, pressed or otherwise formed in the device. Other fastening mechanisms may of course be used.

Additionally, in FIG. 5, a partial cross-section depicts ribs 138. Such ribs 138 provide strength to the extendable mounting piece 104. The ribs 138 also simplify the molding process, while reducing the amount of material required.

Figure 7:
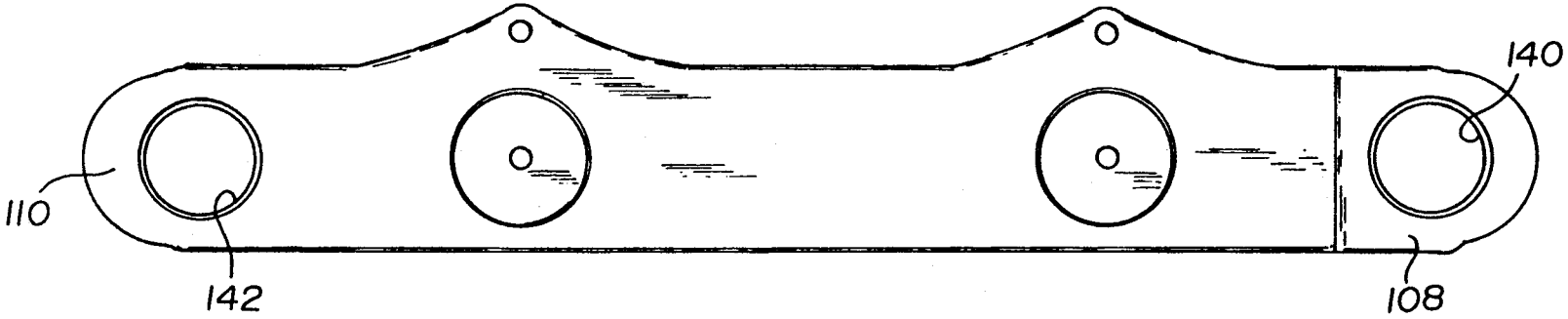
FIG. 7 depicts extendable mounting piece 104.
Figure 8:
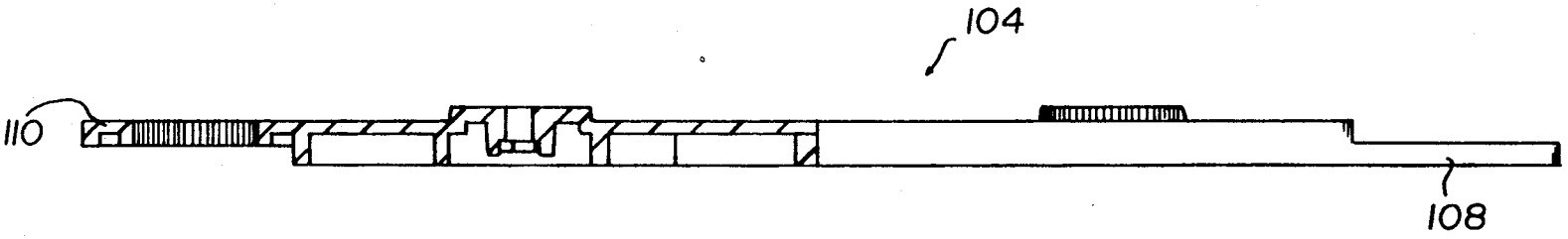
FIG. 8 depicts a side partially cross sectional view of FIG. 7.

FIG. 7 and FIG. 8, combine to depict extendable mounting piece 104. Oppositely disposed from first lower end 108 on extendable mounting piece 104 is second raised end 110. A first lower end 108 on a first extendable mounting piece 104 can slide under a second raised end 110 of a second extendable mounting piece 104. First lower end 108 includes a first end opening 140 capable of aligning with second raised end aperture 142 to join two of extendable mounting piece 104. Second raised end aperture 142 is, of course, in second raised end 110.

Figure 9:
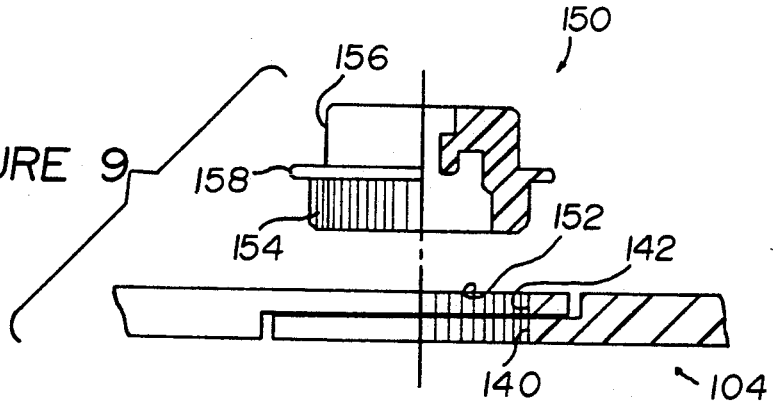
FIG. 9 depicts a partially cross sectional, side view of cover knob 150 for use with extendable mounting piece 104.

FIG. 8 in the partially cross-sectional side view depicts first lower end 108 and second raised end 110, which as combined with FIG. 9 depict the possibility of extendable wall mounting device 100 as shown in FIG. 1. Holding cap 150 fits through first end opening 140 after passing through second raised end opening 142 to join two of extendable mounting piece 104.

Second raised end opening 142 may have a serrated interior 152 to receive an exterior serrated base 154 of cap 150. Cap 150 preferably has a smooth top 156, with a stop ridge 158 between smooth top 156 and serrated base 154. In this fashion, the strength and mounting capabilities of the extendable wall mounting device 100 are clearly shown.

FIG. 10, FIG. 11, FIG. 12, FIG. 13, FIG. 14 and FIG. 15 depict the effect of capping off of the extendable mounting piece 104. The end caps provide for a direct decorative and utilitarian ending for the device 100 when it is no longer desired to continue the device 100.

Figure 10:
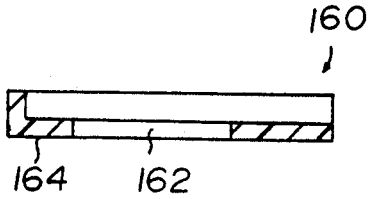
FIG. 10 depicts lower cap 160 to receive first lower end 108.
Figure 12:
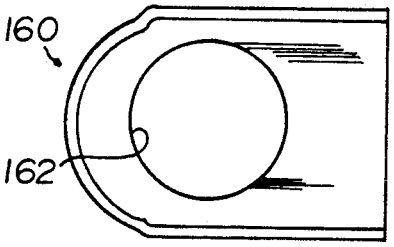
FIG. 12 depicts the side view of FIG. 10.
Figure 14:
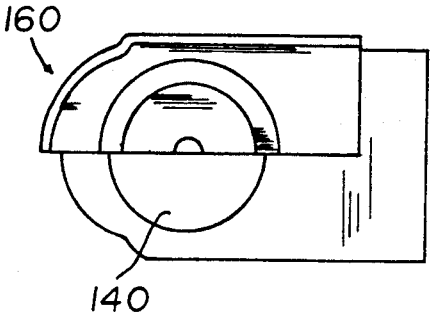
FIG. 14 depicts a half-sectional view of FIG. 10.

FIG. 10, FIG. 12, and FIG. 14 depict the effect of capping off of first lower end 108. Lower cap 160 includes a lower cap slot 162 to receive first lower end 108. Lower cap surface 164 is oppositely disposed from lower cap slot 162 and provides both a cover for first end opening 140 and decorative appearance for extendable mounting piece 104.

Figure 11:
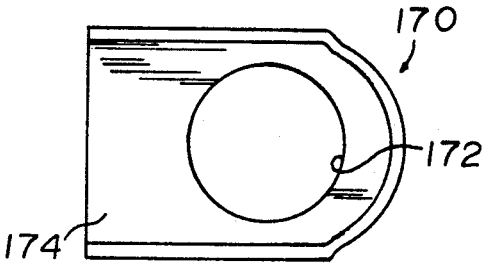
FIG. 11 depicts upper cap 170 to receive second raised end 110.
Figure 13:
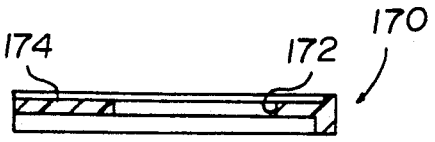
FIG. 13 depicts the side view of FIG. 11.
Figure 15:
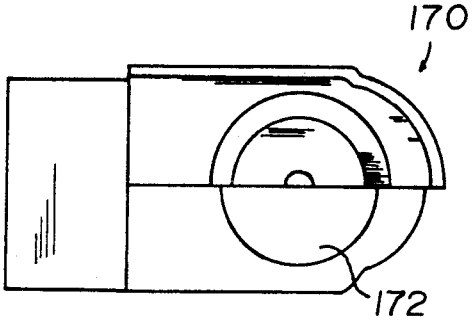
FIG. 15 depicts a half-sectional view of FIG. 11.

Likewise, FIG. 11, FIG. 13, and FIG. 15 depict the effect of capping off of second raised end 110. Upper cap 170 includes an upper cap slot 172 to receive second raised end 110. Upper cap base 174 is oppositely disposed from upper cap slot 172 and provides both a cover for second end opening 142 and decorative appearance for extendable mounting piece 104.

Figure 16:
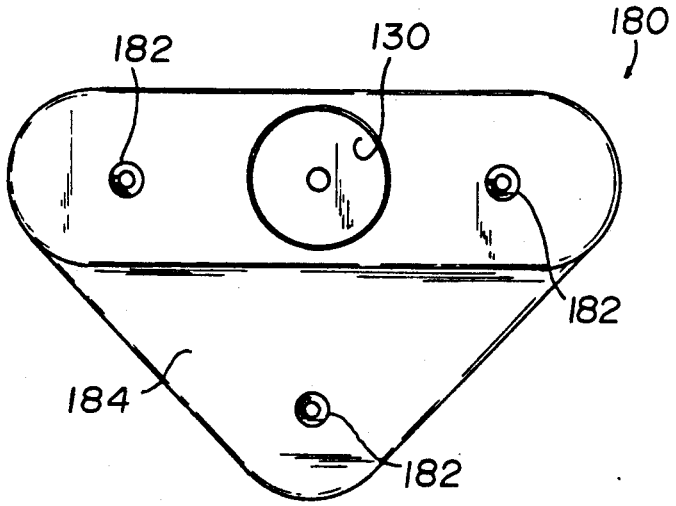
FIG. 16 depicts a heavy duty mounting device 180.
Figure 17:
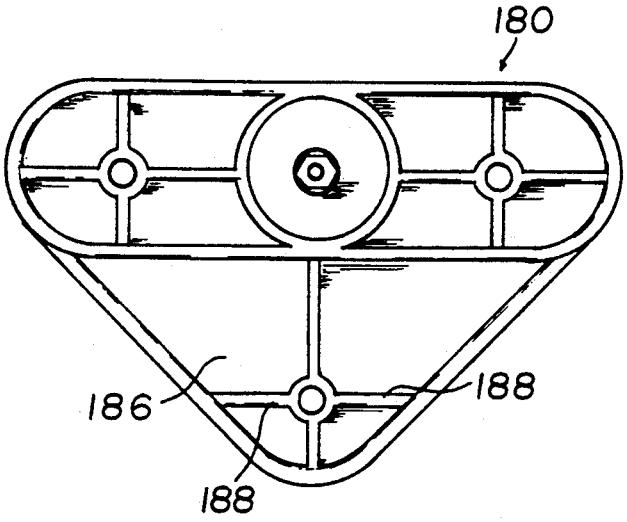
FIG. 17 depicts a rear view of FIG. 16.
Figure 18:
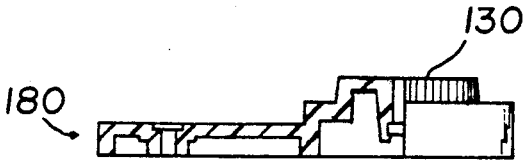
FIG. 18 depicts a side-sectional view of FIG. 16.

FIG. 16, FIG. 17, and FIG. 18 depict a heavy duty mounting device 180 having the mounting wheel 130 thereon. The heavy duty mounting device 180 can be secured to the wall through three strength wall apertures 182 substantially positioned triangularly on the heavy duty mounting device 180. The heavy duty mounting device 180 includes the mounting wheel 130 similar to the device mounting wheel 130 on extendable mounting piece 104. Each of the three strength wall apertures 182 can receive a wall bolt 106. The triangulated structure with the three way combination of wall bolt 106 permit mounting wheel 130 to receive a very heavy device to be mounted on wall 102. The heavy duty mounting device 180 can support a large mirror (not shown) or other heavy item.

FIG. 17 again emphasizes the strong rear side 186 and the rib structure 188 of heavy duty mounting device 180. Such a rib structure provides for strength while minimizing the amount of material used to mold heavy duty mounting device 180.

Figure 19:
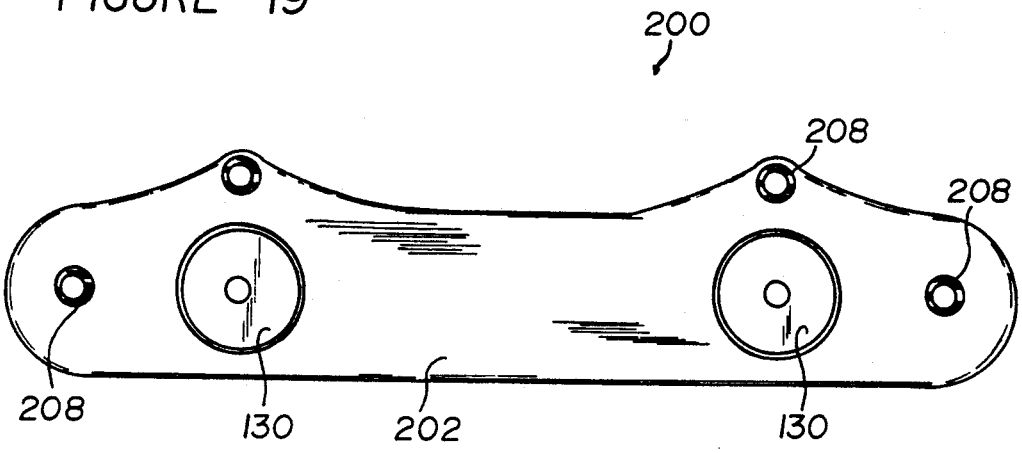
FIG. 19 depicts a front view of fixed mounting piece 200.
Figure 20:
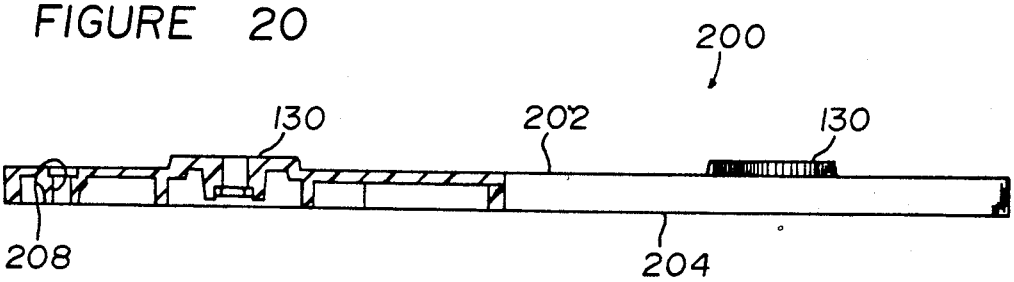
FIG. 20 depicts a side view of FIG. 19.
Figure 21:
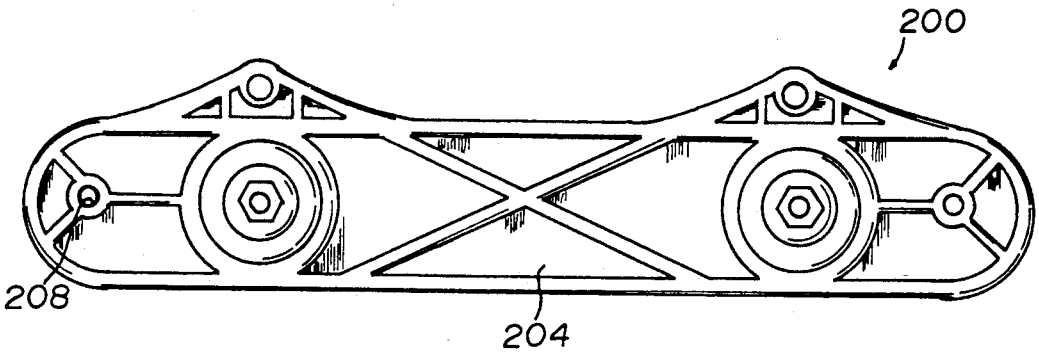
FIG. 21 depicts a rear view of a FIG. 19.

If it is desired just to have two of mounting wheel 130 on a wall 102, fixed mounting piece 200 may be used. Fixed mounting piece 200 may have a structure of the type shown in FIG. 19, FIG. 20, and FIG. 21; with the structure thereof being similar to extendable mounting piece 104, but for the absence of first lower end 108 and second raised end 110. Again the fixed mounting piece 200 is generally flattened on a viewing side 202 and ribbed on a wall side 204. Fixed mounting piece 200 may have standard mounting apertures 208 for being secured to wall 102. Additionally, fixed mounting piece 200 includes two symmetrically placed mounting wheels 130.

Figure 22:
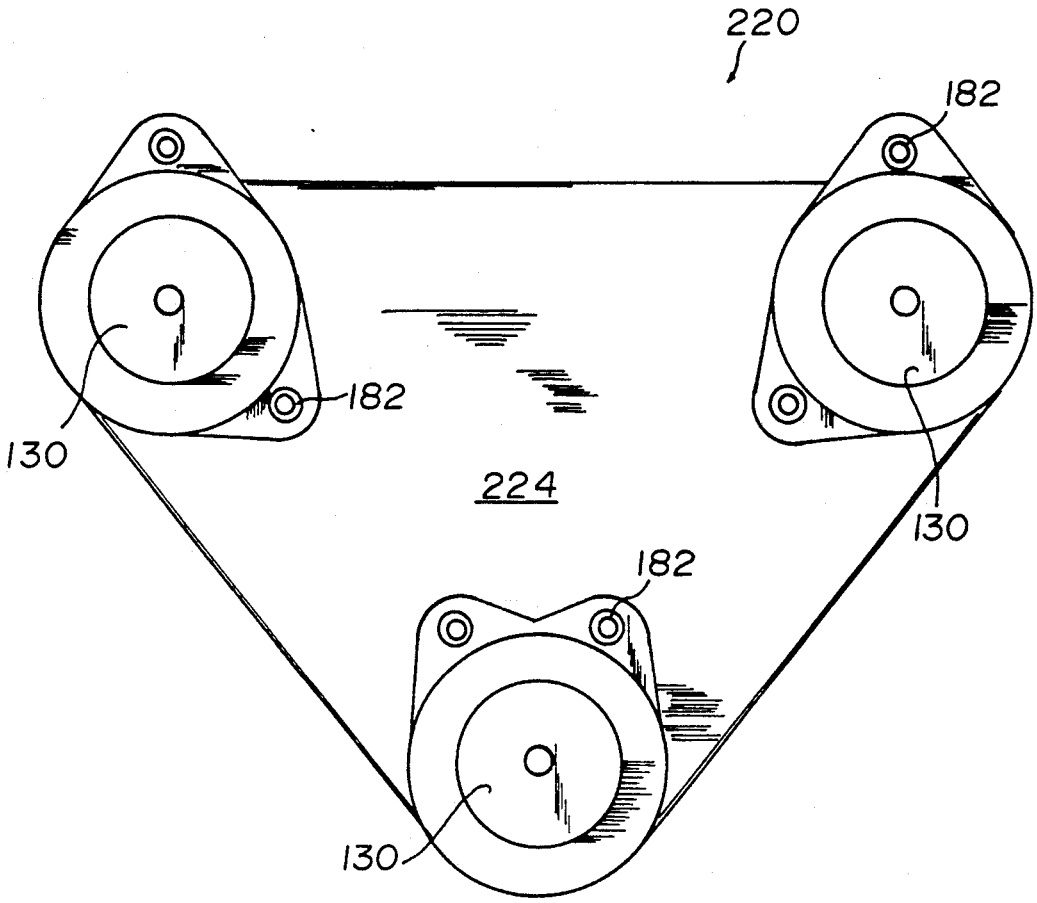
FIG. 22 depicts a triholding model 220.
Figure 23:
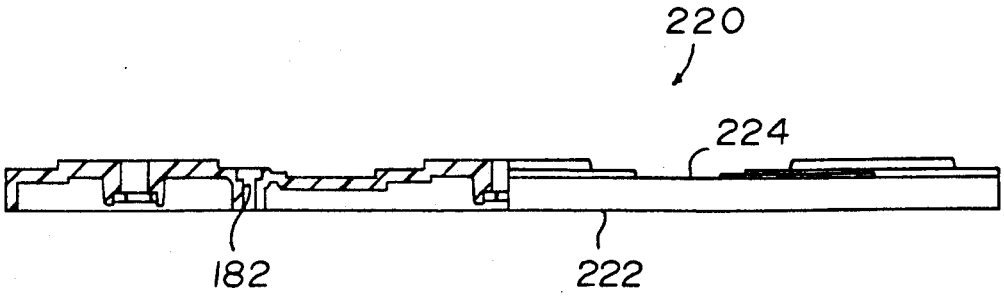
FIG. 23 depicts a side sectional view FIG. 22.

FIG. 22 and FIG. 23 combine to depict a triholding model 220. Triholding model 220 is similar to heavy duty mounting device 180, but for the presence of three of mounting wheel 130. As is shown in the other devices disclosed herein, triholding model 220 has a trimodel ribbed side 222, which is positioned adjacent wall 102, and trimodel flat side 224, which is visible and includes mounting wheels 130.

Triholding model 220 is of a general triangle shape. Also there are six wall apertures 182, each of which may receive a wall bolt 106 as desired. In this fashion, triholding model 220 can be strongly bolted to the wall 102 in one, in two, three, four, five or six places followed by bolting one or more devices to each of mounting wheel 130.

Figure 24:
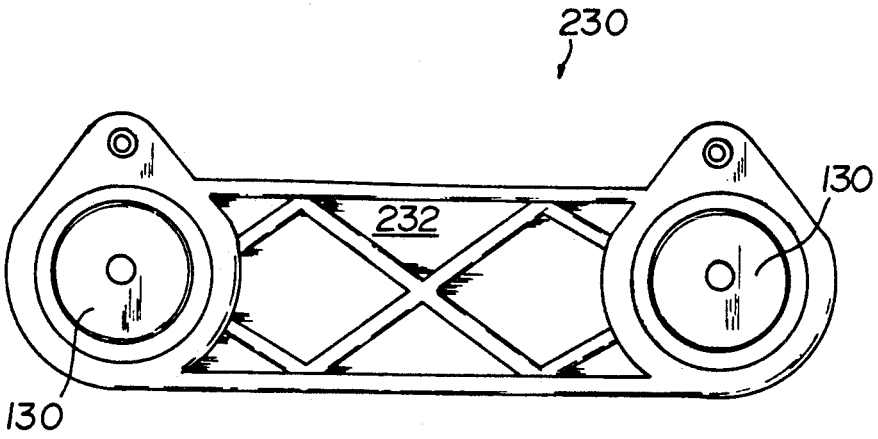
FIG. 24 depicts a fixed front rib mount 230.
Figure 25:
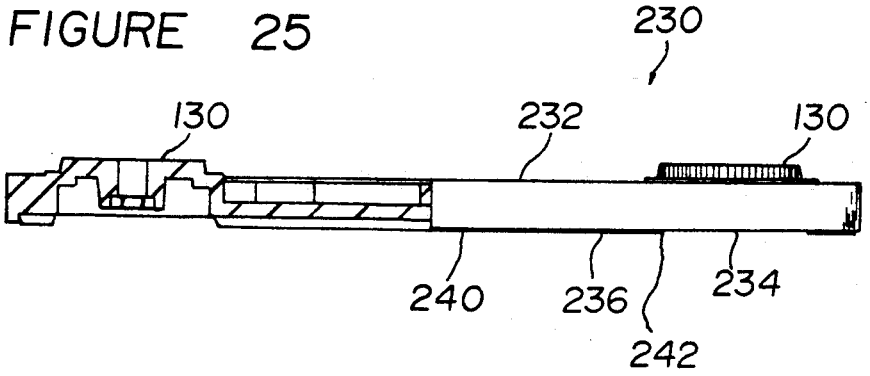
FIG. 25 depicts a side-sectional view of FIG. 24.
Figure 26:
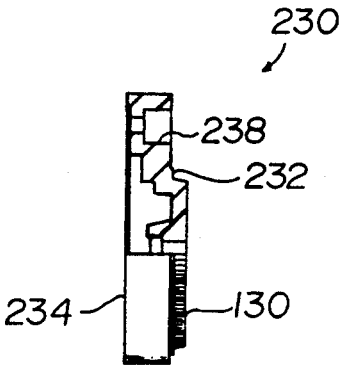
FIG. 26 depicts a partially sectional, end view of FIG. 24.

FIG. 24, FIG. 25, and FIG. 26 depict a double modification of fixed mounting piece 200 in the form of fixed front rib mount 230. Fixed front rib mount 230 has a decorative ribbed front 232, which includes a pair of mounting wheels 130, and a flat back 234, which is adjacent wall 102.

Flat back 234 includes tape sections 236 for an assist in mounting on wall 102. Each tape section 236 includes a double sided tape piece 240 with a removable cover sheet 242. Tape piece 240 has one side secured to flat-back 234. Removable cover 242 is taken off when it is desired to adhesively secure fixed front rib mount 230 to wall 102.

Fixed front rib mount 230 has a rectangular shape with rounded ends. A mounting wheel 130 is adjacent to each of the rounded ends. Above each mounting wheel 130 is a tape aperture 238. Each tape aperture 238 may receive a bolt to assist in mounting. Bolts or tape sections may be used alone or in combination.

Figure 27:
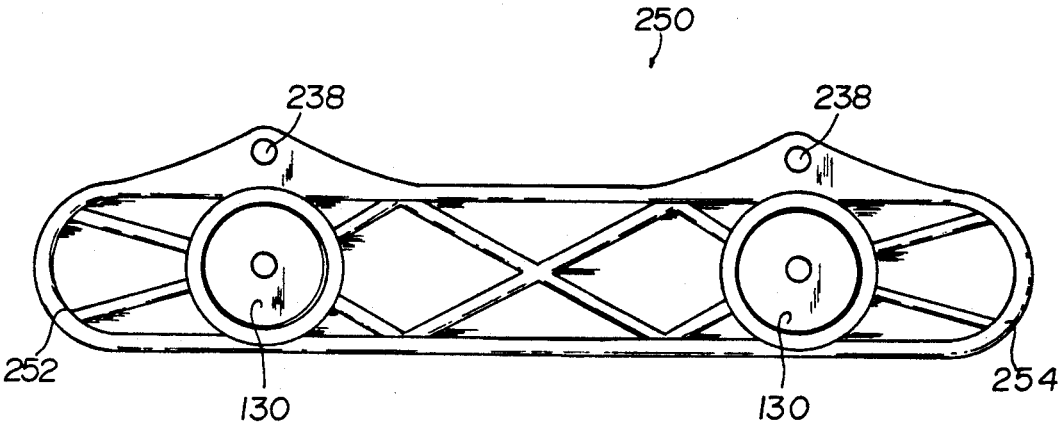
FIG. 27 depicts a front view of an elongated front mount 250.
Figure 28:
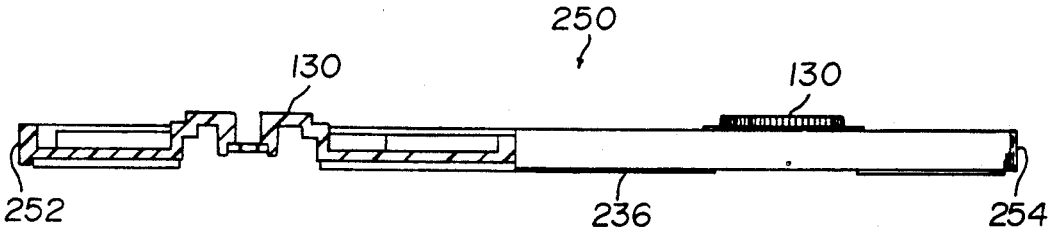
FIG. 28 depicts a side view of FIG. 27.
Figure 29:
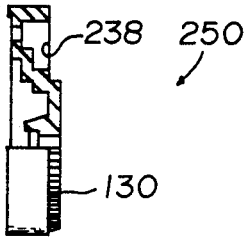
FIG. 29 depicts an end view of FIG. 27.

FIG. 27, FIG. 28, and FIG. 29 depict an elongated version of FIG. 24 by showing elongated front mount 250. Elongated front mount 250 has a rectangular shape with a first extended rounded end 252 and a second extended rounded end 254. A mounting wheel 130 is spaced inwardly from each of the rounded ends.

Elongated front mount 250 includes tape sections 236. Also, Above each mounting wheel 130 is a tape aperture 238.

Figure 30:
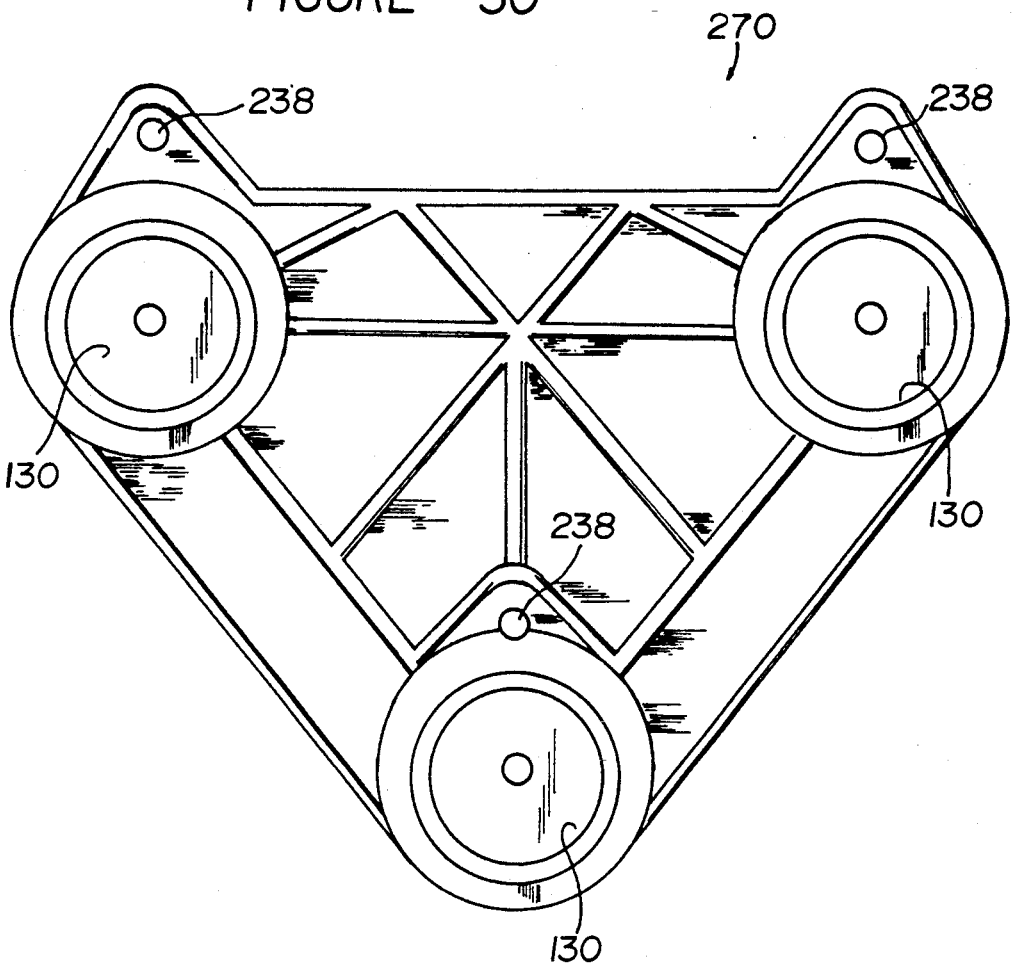
FIG. 30 depicts a triangulated tape mount 270.
Figure 31:
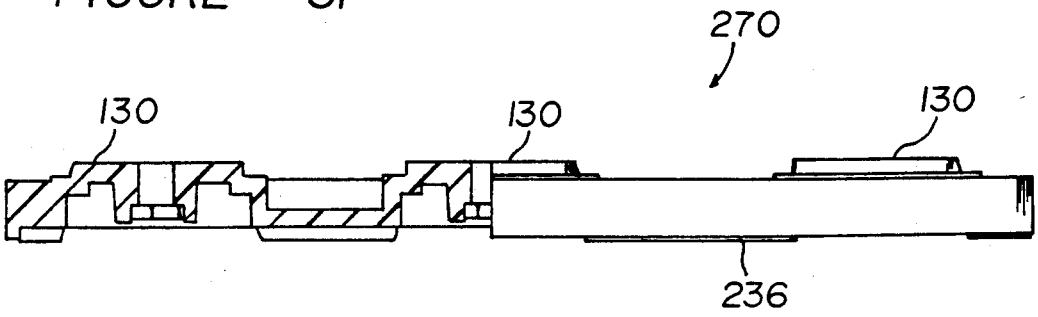
FIG. 31 depicts a side-sectional view of FIG. 30.

FIG. 30 and FIG. 31 depict the triangulated tape mount 270, which is the tape side version of FIG. 16, and provides for a similar reversed structure as described in FIG. 27. A flat and generally triangular shape with ribs in front view is seen in triangulated tape mount 270. Three of mounting wheels 130 are present thereon. Triangulated tape mount 270 includes tape sections 236 and a triangulated set of three of tape aperture 238.

Figure 32:
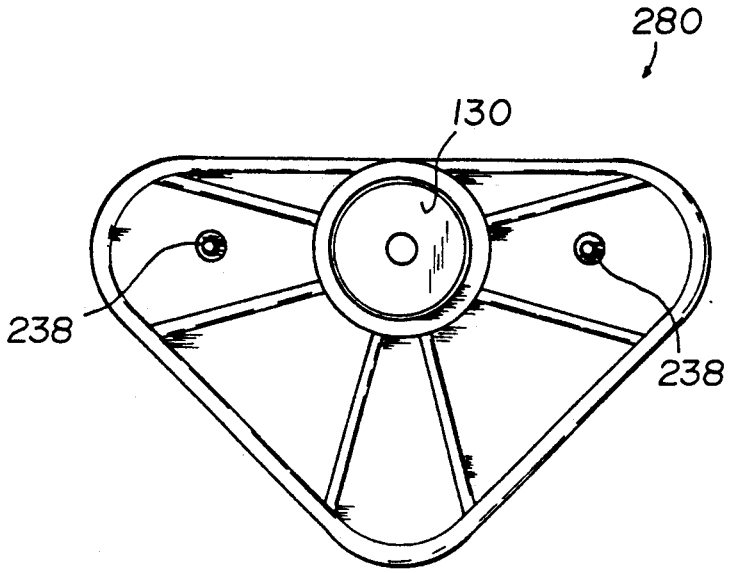
FIG. 32 depicts a triangulated single mount 280.
Figure 33:
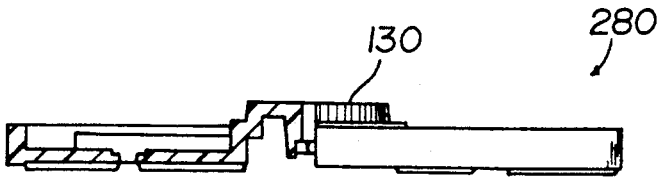
FIG. 33 depicts a side-sectional view of FIG. 32.

FIG. 32, and FIG. 33, is also the tape side version showing triangulated single mount 280. Triangulated single mount 280 has only one mounting wheel 130 and two of tape aperture 238.

Figures 34, 35:
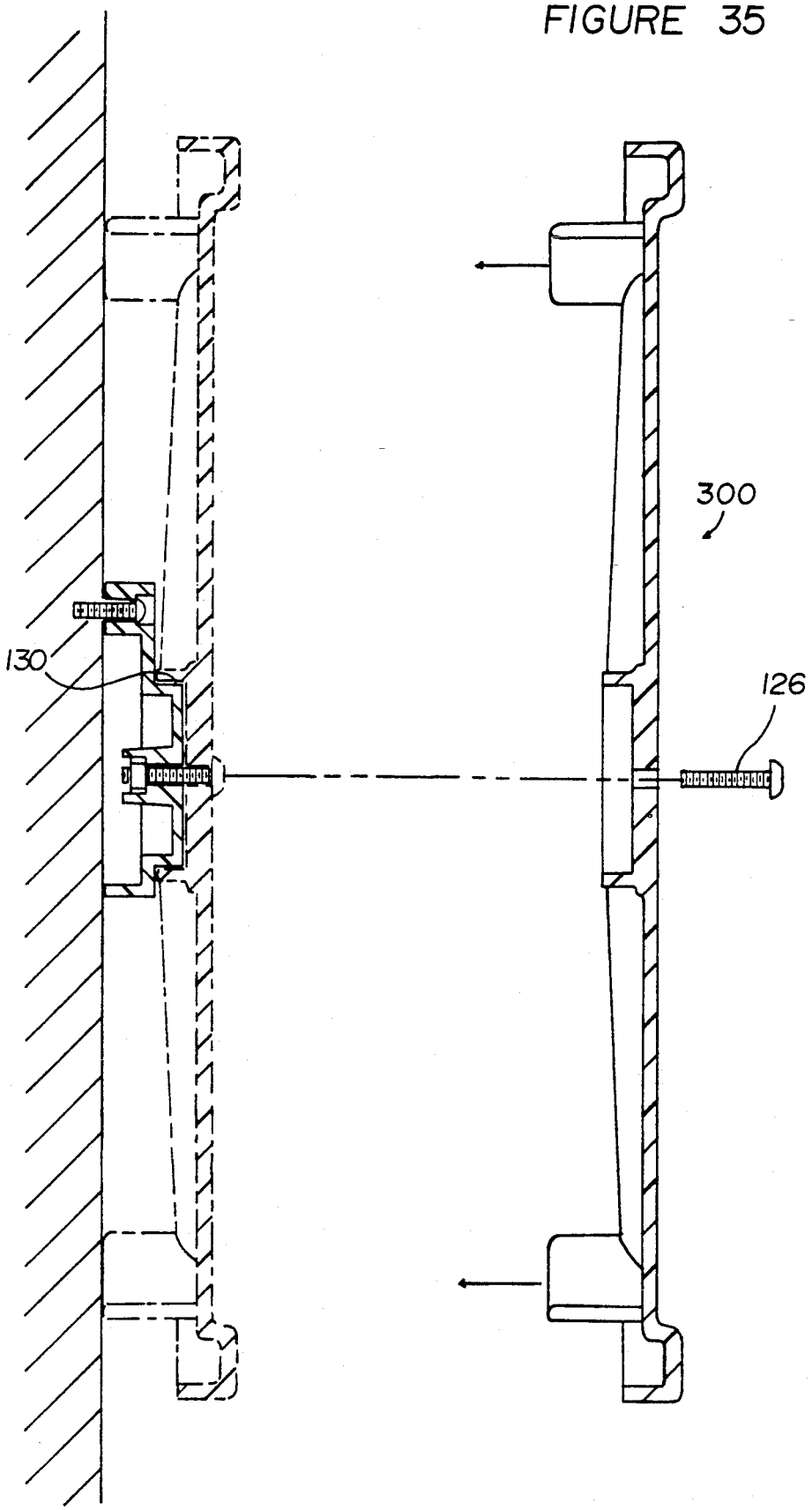
FIG. 34 depicts a side view of plate 300 attached to mounting wheel 130.
FIG. 35 depicts a side view of the plate 300.

FIG. 34 and FIG. 35 combine to emphasize the attachment of any suitable memo board 300 to the desired mounting wheel 130, which may be on any device hereinbefore described. The memo board 300 is brought adjacent to the mounting wheel in FIG. 34 and mounted thereto with a bolt 126 as shown in FIG. 35. In this fashion, very strong, easily removable devices may be secured to the wall and supported thereon.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. In combination a mounting device and an item receiving means for securing an item in a position on a wall, wherein:

a) said mounting device includes a wall side and an item receiving side;

b) said wall side is oppositely disposed from said item receiving side;

c) said wall side is securable adjacent to said wall;

d) said item receiving side includes at least one item mounting means capable of securely but removably securing an item adjacent to said wall;

e) said item mounting means includes a position means for adjusting a position of said item as desired;

f) said item receiving means includes means to receive said item mounting means;

g) said item mounting means includes a device mounting wheel;

h) said device mounting wheel is a raised, cylindrically-shaped portion of said elongated portion;

i) said raised, cylindrically-shaped portion includes a plurality of raised ridges;

j) said ridges are on the outside of said raised, cylindrically-shaped portion;

k) said receiving means is mateable with said raised, cylindrically-shaped portion; and l) said raised cylindrically shaped portion includes a mounting means mounted coaxially therein.

2. The mounting device of claim 1, wherein:

a) said mounting device has a cored side including at least one rib support;

b) said mounting device has a flat side including at least one rib support; and c) said cored side provides strength to said mounting device with a reduction in material required for said mounting device.

3. The mounting device of claim 2, wherein:

a) said mounting device has at least two elongated units;

b) a joining means for said elongated unit is oppositely disposed from said joining means.

4. The mounting device of claim 3, wherein:

a) said elongated unit has at least two item mounting means capable for securely but removably securing an item adjacent to said wall;

b) a first end of said elongated unit is substantially a mirror image of a second end of elongated unit;

c) at least three of said elongated unit are joinable;

d) an angle means permits a first of said elongated unit to be mounted on a first wall to be joined to a second of said elongated unit on a second wall; and e) said first wall is perpendicular to said second wall.

5. The mounting device of claim 4, wherein:

a) said item is a jewelry hanging device removably secured to secured to said elongated unit; and b) said jewelry hanging device includes a v-shaped slot protruding therefrom to receive a piece of jewelry.

6. The mounting device of claim 4, wherein:

a) said item is a sweater hanger;

b) said sweater hanger cooperates with said elongated unit;

c) said sweater hanger includes a sweater base and a sweater receiver;

d) said sweater receiver includes an enlarged knob extending from said sweater base;

e) said sweater hanger includes said receiving means to receive said item mounting means;

f) said item mounting means is a device mounting wheel; and g) said sweater hanger is secured to said device mounting wheel.

7. The mounting device of claim 6, wherein:

a) said device mounting wheel is a raised, cylindrically-shaped portion of said elongated portion;

b) said raised, cylindrically-shaped portion includes a plurality of raised ridges;

c) said ridges are on the outside of said raised, cylindrically-shaped portion; and d) said receiving means is mateable with said raised, cylindrically-shaped portion.

8. The mounting device of claim 1, wherein:

a) said raised cylindrically shaped portion and said mounting means include a mounting nut mounted coaxially therein;

b) said mounting nut receives a mounting bolt; and c) said mounting bolt holds said receiving means on said item mounting means.

9. The mounting device of claim 1, wherein:

a) said mounting device includes three wall strength wall apertures substantially positioned triangularly to support said mounting device on said wall;

b) said item mounting means includes a device mounting wheel; and c) said three wall strength wall apertures permit said item to be heavy.

10. The mounting device of claim 1, wherein:

a) said item mounting means are two in number;

b) said item mounting means includes two said raised cylindrically shaped portions;

c) said raised cylindrically shaped portion includes a mounting nut mounted coaxially therein;

d) said mounting nut receives a mounting bolt; and e) said mounting bolt holds said receiving means on said item mounting means.

11. In combination a mounting device and an item receiving means for securing an item in a position on a wall, wherein:

a) said mounting device includes a wall side and an item receiving side;

b) said wall side is oppositely disposed from said item receiving side;

c) said wall side is securable adjacent to said wall;

d) said item receiving side includes at least one item mounting means capable of securely but removably securing an item adjacent to said wall;

e) said item mounting means includes a position means for adjusting a position of said item as desired;

f) said receiving means includes means to receive said item mounting means;

g) said mounting device has a cored side including at least one rib support;

h) said mounting device has a flat side including at least one rib support;

i) said cored side provides strength to said mounting device with a reduction in material required for said mounting device;

f) said item mounting means includes a raised cylindrical portion having said positioning means thereon;

g) an angle means permits a first of said elongated unit to be mounted on a first wall to be joined to a second of said elongated unit on a second wall; and h) said first wall is perpendicular to said second wall.

12. The mounting device of claim 11, wherein:

a) said cored side is said wall side; and b) said device is secured to said wall by a non-adhesive fastening means.

13. The mounting device of claim 11, wherein:

a) said flat side is said wall side; and b) said device is secured to said wall by an adhesive fastening means.

14. The mounting device of claim 11, wherein:

a) said raised, cylindrically-shaped portion includes a plurality of raised ridges;

b) said ridges are on the outside of said raised, cylindrically-shaped portion; and c) said receiving means is mateable with said raised, cylindrically-shaped portion.

15. The mounting device of claim 11, wherein:

a) said item mounting means includes a device mounting wheel;

b) said device mounting wheel is a raised, cylindrically-shaped portion of said elongated portion;

c) said raised, cylindrically-shaped portion includes a plurality of raised ridges;

d) said ridges are on the outside of said raised, cylindrically-shaped portion; and e) said receiving means is mateable with said raised, cylindrically-shaped portion.

16. The mounting device of claim 15, wherein:

a) said item is a jewelry hanging device removably secured to secured to said elongated unit; and b) said jewelry hanging device includes a v-shaped slot protruding therefrom to receive a piece of jewelry.

17. The mounting device of claim 16, wherein:

a) said item is a sweater hanger;

b) said sweater hanger cooperates with said elongated unit;

c) said sweater hanger includes a sweater base and a sweater receiver;

d) said sweater receiver includes an enlarged knob extending from said sweater base;

e) said sweater hanger includes said receiving means to receive said item mounting means;

f) said item mounting means is a device mounting wheel; and g) said sweater hanger is secured to said device mounting wheel.

* * * * *